US007615166B2

(12) United States Patent
Kobayashi

(10) Patent No.: US 7,615,166 B2
(45) Date of Patent: Nov. 10, 2009

(54) BRUSH MATERIAL FOR MOTOR AND MANUFACTURING METHOD THEREOF

(75) Inventor: Hiroshi Kobayashi, Kariya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 12/400,616

(22) Filed: Mar. 9, 2009

(65) Prior Publication Data

US 2009/0169728 A1 Jul. 2, 2009

Related U.S. Application Data

(62) Division of application No. 11/206,847, filed on Aug. 19, 2005, now abandoned.

(30) Foreign Application Priority Data

Aug. 27, 2004 (JP) ..... 2004-249190

(51) Int. Cl.
*H01B 1/06* (2006.01)
*H01B 1/24* (2006.01)
*H01R 39/20* (2006.01)
*H01R 39/28* (2006.01)

(52) U.S. Cl. ..... 252/506; 252/511; 310/252; 310/253

(58) Field of Classification Search ..... 252/500, 252/506, 511; 310/252, 253
See application file for complete search history.

(56) References Cited

U.S. PATENT DOCUMENTS

| | | | | |
|---|---|---|---|---|
| 2,415,196 | A | 2/1947 | Steinberg et al. | |
| 2,989,490 | A | 6/1961 | Ramadanoff | |
| 4,425,247 | A | 1/1984 | Bely et al. | |
| 4,605,581 | A * | 8/1986 | Stevens et al. | 428/96 |
| 4,799,957 | A | 1/1989 | Vogel | |
| 7,038,351 | B2 | 5/2006 | Kobayashi et al. | |
| 7,067,951 | B2 | 6/2006 | Otani et al. | |
| 7,074,880 | B2 | 7/2006 | Rhine et al. | |
| 7,105,977 | B2 | 9/2006 | Kobayashi | |
| 7,390,344 | B2 | 6/2008 | Kobayashi | |
| 2004/0212272 | A1 * | 10/2004 | Arai et al. | 310/251 |
| 2007/0013258 | A1 | 1/2007 | Kobayashi | |
| 2008/0220162 | A1 * | 9/2008 | Ko et al. | 427/215 |
| 2008/0278026 | A1 | 11/2008 | Kobayashi | |

FOREIGN PATENT DOCUMENTS

| | | |
|---|---|---|
| JP | 02197238 | 8/1990 |
| JP | 2001-298913 | 10/2001 |
| JP | 2004-173486 | 6/2004 |

* cited by examiner

*Primary Examiner*—Mark Kopec
*Assistant Examiner*—Jaison P Thomas
(74) *Attorney, Agent, or Firm*—Oblon, Spivak, McClelland, Maier & Neustadt, L.L.P.

(57) ABSTRACT

A motor brush material contains copper particles dispersed and configuring particle group structure supported in inner pores of a sintered body containing carbon as a major component.

11 Claims, 3 Drawing Sheets

BRUSH MATERIAL FOR MOTOR AND MANUFACTURING METHOD THEREOF

CROSS REFERENCE TO RELATED APPLICATIONS

This application is divisional of and claims the benefit of priority from U.S. Ser. No. 11/206,847, filed Aug. 19, 2005, and is based on and claims priority under 35 U.S.C. § 119 to Japanese Patent Application 2004-249190, filed on Aug. 27, 2004, the entire contents of which are incorporated herein by reference.

FIELD OF THE INVENTION

This invention relates to a brush material for a motor and a method for manufacturing the brush material for a motor.

BACKGROUND

In a motor having a brush, electricity is supplied to the motor when the brush contacts with a commutator. A coil wound around a core of a rotor is connected to the commutator. When electricity is supplied to the coil, the rotor is rotated by attracting/repulsive force from a permanent magnet provided in a housing and facing the rotor.

In the case of motors having structure described above, the brush and the commutator are slidably contacted together when the motor is under operation. Accordingly, the contact surfaces tend to wear. In order to prevent wear generations of brushes for motors, various considerations for brush materials and brush hardness were made.

In particular, for a brush motor material utilized in a brush motor for vehicles, a conventional metal-graphite brush material is described in JP2001-298913A. According to the document, longevity of brushes is considered. The metal-graphite brush material is manufactured as follows. First, carbon particles, copper particles, and a binding agent are mixed. Next, the mixture is sintered.

One example of a method for manufacturing a metal-graphite brush material will be explained precisely as follows. First, natural carbon particles are mixed with phenol resin solution as a binder and kneaded. Then, the mixture is formed into particles of predetermined shape. The obtained carbon particles are mixed with copper powder in the amount corresponding to current density to be applied to the brush and solid lubricant of required amount. Then, the mixture is formed into a predetermined shape. Then, the formed mixture is sintered in non-oxidative atmosphere in which oxygen is excluded. In this case, phenol resin coatings formed on surfaces of carbon particles are carbonized into amorphous carbon by reduction sintering. The amorphous carbon plays a role for binding carbon particles. Then, during sintering, carbon dioxide and vapor are vaporized from organic compounds originating in the phenol resin. Accordingly, many pores are formed on the surface and inside the sintered body.

However, it is known that the conventional motor brush material tends to generate spark discharge.

For example, considering the case of a metal-graphite brush material, the brush slides along the commutator and contacts therewith. From the fact that the brush and the commutator have some degree of surface roughness, the brush and the commutator can be assumed to be in contact with each other through three spots in microscopic view, the spots changing with time according to the condition of sliding. Electric field is applied to the brush through the three spots. The electric field causes to separate π electrons from the carbon particles of metal-graphite brush material. As a result, charge is induced in the metal-graphite brush material. Then, the induced charge transfers toward material of higher electric conductivity, in the case of the metal-graphite brush material, copper powder. At this time, because the copper powder has small capacity for storing charge, charge having transferred toward copper powder discharges toward outside the copper powder, which induces spark discharge.

Then, the discharge phenomena in which charge is emitted raises temperature near cores of spark discharge abruptly. Therefore, volumes of copper powder and carbon particles are abruptly expanded. Thus, bound between the copper powder and the carbon particles are broken caused by difference between volume expansion rates of the copper powder and the carbon particles. Further, copper powder has a sublimation point lower than that of carbon. Therefore, copper powder sublimates before carbon sublimates. Thus, volume reduction of copper powder caused by sublimation breaks bonds between copper powder and carbon particles. Accordingly, copper powder can easily drop from carbon particles, which causes easiness of wear of the brush. Further, noise signals are generated corresponding to the amount of charge emitted during spark discharge.

A need thus exists for a motor brush material utilized for a motor not easily generating spark discharge which can cause wear of a brush, and a method for manufacturing the motor brush material.

SUMMARY OF THE INVENTION

According to an aspect of the present invention, a motor brush material contains copper particles dispersed and configuring particle group structure supported in inner pores of a sintered body containing carbon as a major component.

According to a further aspect of the present invention, a method for manufacturing a motor brush material includes the steps of infiltrating solution containing a copper complex into inner pores of a sintered body containing carbon particles by means of low-pressure infiltration and generating copper particles in the inner pores by means of thermal decomposition of the copper complex.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
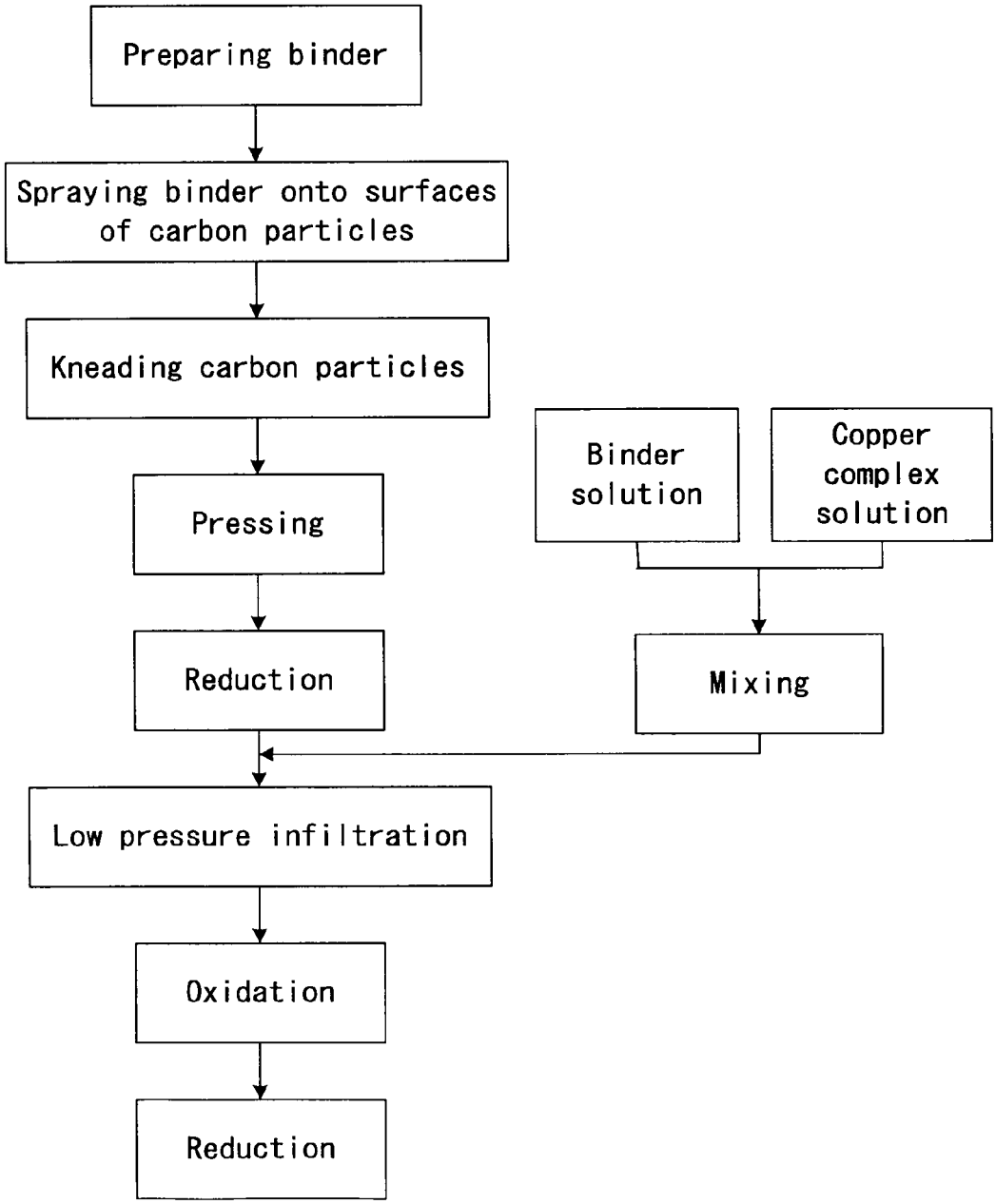
FIG. 1 represents a process diagram illustrating a process for manufacturing a motor brush material.

An embodiment of the present invention will be explained. According to the embodiment of the present invention, a material of a brush for a motor is a sintered body containing carbon as a major component. The sintered body includes inner pores in which copper particles are supported. In the configuration described above, the number of cores of spark discharge can be increased, and simultaneously, energy of the spark discharge can be dispersed into the increased number of cores. Thus, energy of one spark discharge can be reduced. Further, volume of the core of spark discharge can be reduced, and simultaneously, electric charge stored in the core of the spark discharge can be reduced. Thus, energy emitted from the spark discharge can be reduced. Accordingly, effects occurred from the spark discharge of the material of the brush for the motor can be reduced, and simultaneously, wear of the brush can be reduced. Further, because the amount of discharged charge is reduced, a level of noise signals caused by the spark discharge can be lowered.

Taking a graphite-metal brush material as an example from conventional motor brush materials, copper powder is dispersed in the graphite-metal brush material as an isolated state. Accordingly, charge induced in the graphite-metal brush material transfers toward copper powder existing nearest from the charge. At this time, electric conductivity of carbon particles is lower than that of the copper powder, and composition ratio of the carbon particles is larger than that of the copper powder. Accordingly, when charge transfers from the carbon particles to the copper powder, it is assumed that the carbon particles generate heat.

On the assumption described above, if the copper powder is formed as a continuous electrically conductive path, not if the copper powder is dispersed and isolated, temperature rise caused by transfer of the electric charge is preventable. It is preferable that the continuous electrically conductive path, configured from groups of copper particles, is formed on the surfaces of the carbon particles because the graphite-metal brush material has a constraint of current density. In other words, if particle structure of copper configuring the continuous electrically conductive path through which electricity is transferred can be formed on the surfaces of the carbon particles, generation of heat caused by transfer of the charge through the electrically conductive path can be prevented. Then, when the particle structure through which the charge is transferred functions as emitting portions for emitting the charge, because the emitting portions are formed as groups of the copper particles, as the diameter of the copper particles becomes smaller, cores emitting the charge are formed numerously. Accordingly, the amount of charge emitted from one core of discharge becomes substantially small. Thus, the temperature rise caused by the spark discharge can be prevented. In addition, because the amount of discharged charge becomes smaller, the level of noise signals caused by the spark discharge can be prevented.

In other words, forming the group structure of the copper particles on the surfaces of the carbon particles, $\pi$ electrons separated from the carbon particles can be captured by the copper particles on the surfaces of the carbon particles. Accordingly, moving distance of the charge separated and induced from the carbon particles becomes shorter, and heat generation in accordance with the charge transfer can be prevented. Further, because the $\pi$ electrons separated and induced from the carbon particles can transfer through the group structure of the copper particles formed as particle group structure continuously provided on the surface of the carbon particles, heat generation accompanying with the charge transfer can be better prevented than the case of the charge transfer through the carbon particles of relatively high specific resistance.

Further, because forming the copper particles into microparticles can increase the number of cores of the spark discharge substantially, and disperse the energy of the spark discharge into small amount, the energy emitted from one core of the spark discharge can be reduced. Further, because volume of one core of the spark discharge is substantially reduced, the amount of charge stored in one core of the spark discharge can be reduced. Thus, the energy emitted from the spark discharge can be reduced. Further, because the amount of charge emitted from the spark discharge is reduced, a level of noise signals caused by the spark discharge can be lowered.

In the view described above, the inventor of the present invention investigated on two methods: one is a method for forming group structure of copper particles on surfaces of carbon particles; second is a method for forming microparticles of copper particles. The investigation was conducted focusing which method contributes to prevent wear of the brush more effectively. As a result of that, the inventor of the present invention found that forming microparticles of copper particles contributes to prevent wear of the brush more effectively by far.

An electric resistance of natural carbon particles is approximately $10^{-4}$ Ωcm in terms of a specific resistance in a direction of an axis along which carbon atoms forming hexagonal (a-axis), and approximately 1Ω in terms of a specific resistance in a direction of an axis (c-axis) vertical to the axis along which carbon atoms forming hexagonal. On the other hand, specific resistance of the copper is $1.7\times10^{-6}$ Ωcm. The $\pi$ electrons separated and induced from the carbon particles are valence electrons forming 2Pz orbital of the carbon atoms forming the carbon particles. Heat generation phenomena are mainly caused by transfer of the $\pi$ electrons in the carbon particles along the a-axis, and can be estimated on the basis of the specific resistance along the a-axis. Accordingly, ratio between the amount of heat generated when the charge transfers in the carbon particles and the amount of heat generated when the charge transfers in the copper particles can be approximated to a ratio between the amount of the generated heat estimated on the basis of the specific resistance of the carbon particles along a direction of the a-axis and the amount of generated heat estimated on the basis of the specific resistance of the copper. The ratio described above is only approximately $10^2$.

On the other hand, the amount of discharged energy reduced owing to effects of forming microparticles is determined from sizes of particles. Copper powder utilized for a conventional metal-graphite brush material is electrolytic copper powder of dendritic shape. When approximating the dendritic shape to spherical powder, the diameter is from 10 to 50 μm. In this time, assuming that the average particle diameter of the electrolytic copper powder approximated to a spherical powder is 20 μm, and assuming that the size of the copper particles made into microparticles is 20 nm, volume ratio of the average particle diameter of the electric copper powder and the size of the copper particles made into microparticles is $10^{-9}$. The difference of the volume ratio is substantially larger than that of the difference between the specific resistances.

Accordingly, containing the copper particles made into numerous microparticles in the metal-graphite brush material, and inducing the spark discharge around the copper microparticles as the core, it can be assumed that the wear of the brush caused by the spark discharge can be substantially reduced. According to this idea, the copper particles need not be formed to a continuous group structure. It can be sufficient only if the copper particles are formed to numerously dispersed microparticles.

Further, for enabling to capture the $\pi$ electrons separated from the carbon particles by the copper particles existing near the $\pi$ electrons, it is preferable that the copper powder be dispersed onto near spaces of almost all the surfaces of the carbon particles. Then, as the amount of charge collected together and discharged from groups of the $\pi$ electrons becomes smaller, the amount of discharge energy emitted from the copper particles becomes smaller. Therefore, it is preferable that the number of copper microparticles exist near the carbon particles.

The inventor focuses to inner pores existing in the brush material for carrying out the idea described above. For manufacturing a conventional motor brush material, a binder is utilized when the carbon particles are kneaded. Then, the mixed carbon particles are reduced and sintered in atmospheric air in which oxygen is excluded. At this time, the binder transforms into amorphous carbon. Simultaneously, aromatic compounds of low molecular weight, for example, gas of phenols such as phenol or xylenol, methane gas, carbon dioxide gas generated on the basis of methylene bond of the binder, are generated by thermal decomposition of the binder. Thus, pore structure is formed in the brush material. The volume ratio of the inner pores is approximately 20%. The dispersed numerous copper particles are supported in the inner pores. The spark discharge is usually generated around the copper particles as the core. Further, because the formed inner pores are continuous each other and the pores surely exist near the grain boundary of the carbon particles, the $\pi$ electrons separated from the carbon particles can be surely captured into the copper particles supported in the pores located nearest from the $\pi$ electrons. Further, when the copper particles are fine and numerous, the number of $\pi$ electrons separated from the carbon particles and collected into one copper particle can be reduced. As a result, the amount of charge discharged from one copper microparticle can be small. Thus, wear of the brush caused by the discharge can be reduced.

In addition, it is preferable that the copper particles are supported in the pores of the amorphous carbon. The amorphous carbon has an electric resistance close to that of the carbon particles. In addition to that, the amorphous carbon can be easily destructed by mechanical stress as same as the carbon particles. Thus, these properties of amorphous carbon do not give undesirable influence on the sliding ability of the brush.

According to the embodiment of the present invention, the motor brush has properties required for a conventional motor brush. In addition to that, the motor brush according to the embodiment of the present invention can reduce occurrence of the spark discharge. In following, a method for manufacturing the motor brush material will be explained.

According to the embodiment of the present invention, the method for manufacturing the motor brush material includes the steps of infiltrating solution of a copper complex into pores of a sintered body containing carbon particles by means of low-pressure infiltration, and generating copper particles from the copper complex by means of thermal decomposition. According to the steps, copper particles are supported in pores formed in a motor brush material of the sintered body.

Then, it is preferable that the process for generating the copper particles from the copper complex by means of thermal decomposition includes steps of performing the heat process on the copper complex in the oxidative atmosphere for thermally decomposing the copper complex and thus separating the copper atoms from the copper complex for producing copper particles having coatings of copper oxide, and performing a reduction process in reductive atmosphere for reducing the coatings of the copper oxide particles into the copper particles. In other words, the heat process in the oxidative atmosphere for the copper complex separates copper atoms from the copper complex. As the temperature of the heat process increase, the copper atoms form groups and grow into copper particles having the coatings of the copper oxide on the surface. Then, the reduction process reduces the coatings of the copper oxide into copper. Thus, the step of forming the copper particles from the solution of the copper complex and the step of supporting the copper particles in the inner pores can be performed simultaneously.

Further, it is preferable that the copper complex solution infiltrated into the pores contain a binder. Infiltrating the copper complex solution with the binder into the inner pores of the brush material and processing as described above enable to support the generated copper particles in the pores.

It is preferable that the binder have a thermal decomposition temperature higher than the thermal decomposition temperature of the copper complex, and the binder be reduced into amorphous carbon in the process of reducing the copper oxide into the copper particles. By doing this, the binder is not decomposed during the thermal decomposition and the oxidative reaction of the copper complex, but the binder is reduced into amorphous carbon in the process of reducing the copper oxide into copper atoms. Accordingly, the binder can be infiltrated into the pores with the copper complex solution, and the copper particles generated in the pores can be supported by the amorphous carbon.

According to views described above, it is preferable that the binder is one of phenol resins represented by chemical formula 1 below. The phenol resins are kinds of synthetic resins having highest reduction rate into amorphous carbon. Because there are various phenol resins of different molecular structures and molecular weights, a phenol resin of preferable thermal decomposition property can be selected as required basis.

[Chemical formula 1]

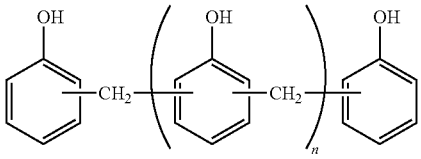

Further, it is preferable that the copper complex is a copper carboxylate complex. A copper complex of amines, amino acids, oxyacids or the like can be employed instead of the copper carboxylate complex for separating and extracting the copper atoms by thermal decomposition process. However, thermal decomposition temperatures of those copper complexes are higher than those of the copper carboxylate complexes. Accordingly, it is more preferable that the calboxylate copper complex is employed because metal particles can be formed at lower temperature. In other words, the metal atoms thermally decomposed from metal complex become metal molecules, then grows to metal particles. Then, as temperatures at which metal particles grow become lower, metal particles grow slower and grow into finer particles. Accordingly, it is preferable that the thermal decomposition temperature of the metal complex is lower.

In addition, solubility of copper carboxylate into alcohols is high. On the other hand, phenol resin can be solved into alcohols and ketones at any rate. Accordingly, calboxylate copper solution solved in alcohols and phenol resin solution solved in alcohols are mixed well together. In terms of this view also, copper carboxylate and phenol resin are good combination.

Preferable example of manufacturing a motor brush material according to the embodiment of the present invention will be explained with reference to FIG. 1.

Firstly, binder utilized during kneading of carbon particles is prepared. The binder is utilized not only for kneading the carbon particles, but also for binding carbon particles when reduced into amorphous carbon. Accordingly, it is preferable that a phenol resin be utilized as a binder. However, it is not limited. Synthetic resins other than phenol resins having similar functions can be employed. In addition, it is preferable that temperature for reducing the binder into amorphous carbon be lower because manufacturing costs can be low.

Next, the binder is adhered onto surfaces of carbon particles by means of spraying. After that, the carbon particles are kneaded, pressed by a predetermined pressing force, and formed into a predetermined shape such as a rectangular. Then, the carbon particles are sintered in reductive atmosphere. At this time, the binder is reduced into amorphous carbon. At the same time, the binder is thermally decomposed into aromatic compounds of low molecular weight, such as phenols (phenol, xylenol), and gases originating in methylene bond such as methane gas and carbon dioxide gas. Thus, the generated gases form pores in the rectangular sintered product. In addition, copper powder can be optionally mixed into the carbon particles at the time of forming the carbon particles into a predetermined shape as in a conventional method. The amount of mixed copper powder can be determined according to required current density.

Then, mixture of copper complex solution such as a copper carboxylate solution solved into an alcohol having high solubility of the copper carboxylate and a binder solution such as a phenol resin solution having compatibility with the copper carboxylate-alcohol solution are prepared. The mixture is infiltrated into the sintered product of the carbon particles having pore structure obtained as described above by means of low-pressure infiltration.

After the infiltration, the resulting product is processed by oxidation process for thermally decomposing the copper complex solution filled in the inner pores. As described above, separating copper atoms, generating copper clusters, and generating copper particles can be conducted approximately at the same time. The copper particles generated as described above are particles of molecular level. Accordingly, degree of activity of the copper particles is high. Then, the copper particles grow as groups of copper as the copper particles take in adjacent copper in the state of cluster. Then, when the temperature is further raised, a growing speed of the copper particles can be accelerated. Thus, the copper particles are formed. Here, the grown copper particles have coatings of the copper oxide of several angstroms in thickness on the surface. The reason why the coatings of the copper oxide is only formed on the surface can be assumed that a growing speed of the copper particles from the copper clusters is greater than an oxidative reaction speed of the copper.

Then, the copper oxide is reduced into copper by means of reduction process. It is preferable that the reduction process is performed in nitrogen gas atmosphere containing hydrogen gas. It is preferable that the reduction process be performed at the temperature near the temperature of oxidation process for preventing structure changes of copper oxide particles having already formed.

Further, the higher the concentration of solved copper complex becomes, the higher the density of the generated copper particles becomes. Accordingly, it is preferable that the concentration of materials of the copper complex, that is, solved copper compound and acid, be high. In addition, the lower the temperature of thermal decomposition of the copper complex becomes, and the wider the temperature range for controlling the growing speed of the copper oxide particles generated by thermal decomposition of the copper complex becomes, the wider the variety of controlling copper oxide particle structures becomes.

Figure 2:
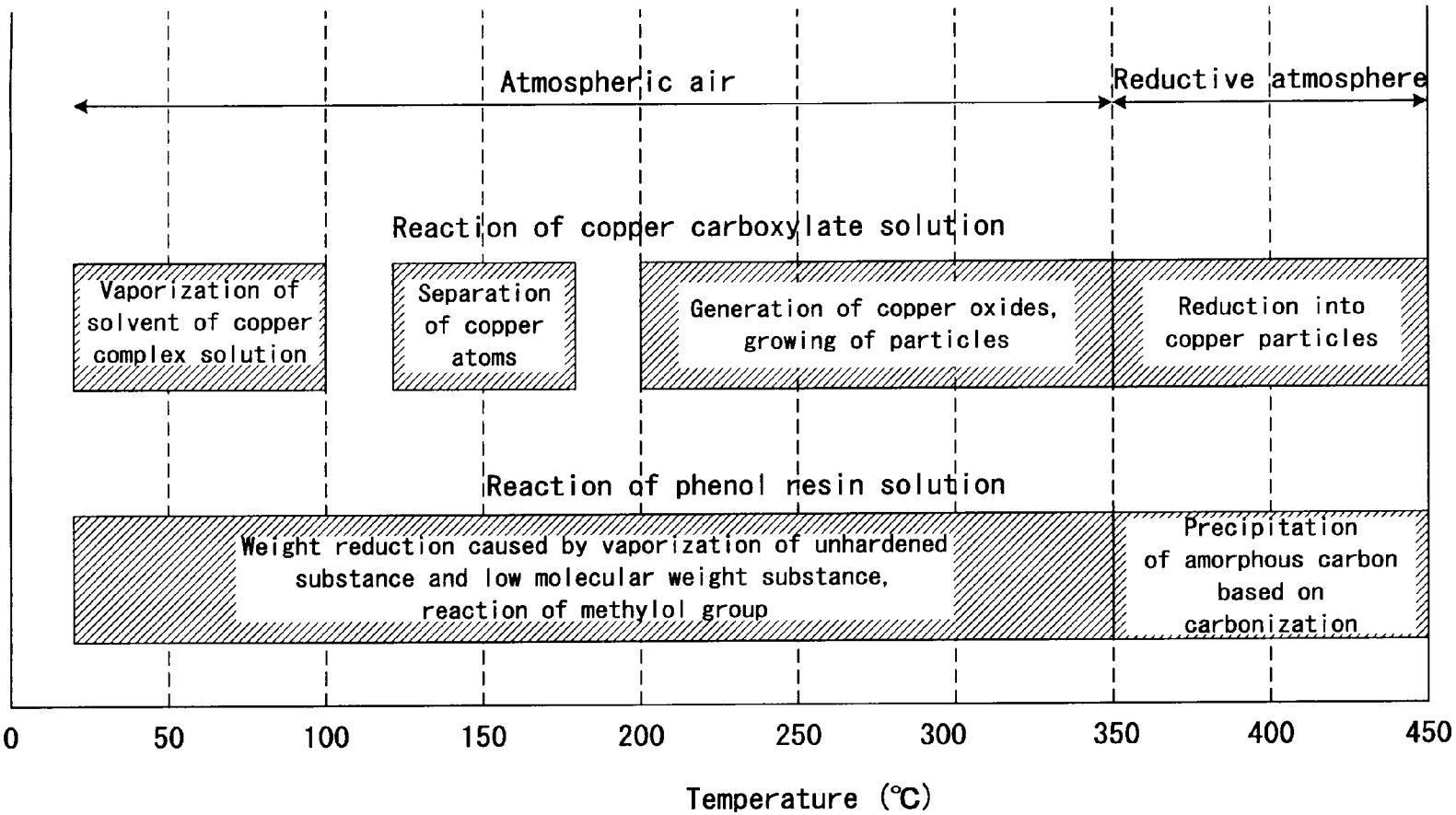
FIG. 2 represents a diagram illustrating heat decomposition properties.

In following, actions of a copper complex and a binder during heat process will be explained taking an example that a copper carboxylate and a phenol resin-methanol solution are infiltrated into pores with reference to FIG. 2. In addition, as a phenol resin, a denatured phenol resin into which methylol groups are introduced is utilized. At first, the methanol solution of the copper carboxylate and the phenol resin is infiltrated into pores. Then, the resulting product is heated in atmospheric air. Methanol as a solvent is vaporized by the time the temperature achieves to 100° C. After that, the copper carboxylate is thermally decomposed into copper atoms approximately after the temperature exceeds 120° C. At this time, in accordance with the thermal decomposition of the copper carboxylate, carbon dioxide and vapor are generated. Further, when the temperature exceeds 200° C. by heating, the copper particles grow as the copper clusters take in adjacent copper clusters.

On the other hand, after the solvent vaporized, by the time the temperature achieves to 350° C., unhardened substance and substance of lower molecular weight originally contained in the denatured phenol resin is vaporized, methylol groups of the phenol resin are dissociated, and thus the phenol resin is thermally decomposed into powder. Then, the copper oxide described above is adhered to the powder. Thus, the copper oxide is supported in the pores.

After that, the resulting product is further heated in reductive atmosphere. At the time the temperature achieves to approximately 450° C., the powder thermally decomposed from the phenol resin becomes amorphous carbon by carbonization. Approximately at the same time, the copper oxide is reduced into copper. When reduced, the copper oxide is kept to adhere to the powder of the phenol resin. Accordingly, the copper particles are formed and grow maintaining the condition that the copper particles are adhered to the amorphous carbon.

Thus, the generated copper particles can be adhered to the amorphous carbon. Then, the copper particles can be supported in the pores. In spite of high degree of activity of copper particles, the supported copper particles are stable. In reality, because the copper particles have high degree of activity, the copper particles continue growing under the condition of high temperature even when the coatings of the copper oxide are formed on the surface. In addition, because the thickness of the coatings is sufficiently thin, the coating does not cause increase of resistance of the copper particles so much. Here, because the coating of the copper oxide is stable under the condition of each temperature, a further oxidative reaction does not occur.

In addition, higher temperature is preferable in terms of higher conversion rate of phenol resin into amorphous carbon because phenol resin is more easily carbonized as the temperature becomes higher. On the contrary, as the temperature becomes higher, the copper particles tend to grow larger. Accordingly, lower temperature is preferable in terms of preventing particles from growing larger for obtaining finer microparticles. In other words, there is a trade-off between obtaining higher conversion rate and making finer microparticles. Thus, the temperature need to be controlled according to desired properties. In the example described above, it is preferable that the temperature is controlled up to 450° C. in order for preventing particles from growing larger as much as possible simultaneous with obtaining 50% or greater conversion rate of phenol resin into amorphous carbon.

Examples of brush materials according to the embodiment of the present invention are evaluated from investigation results of continuous operation tests of motors having a brush made of the brush materials according to the embodiment of the present invention. In each operation test, the amount of wear of each brush is measured after 100 hours of continuous operation and after 300 hours of continuous operation under the condition of 78.5 kPa of load applied to the commutator of the brush, 3.9 m/s of rotational speed of the commutator, and room temperature. Area of sliding surface of each brush is identical one another, 8 mm×5 mm.

Approximate thermal decomposition temperatures of carboxylic acids are determined according to molecular structures and molecular weights. The thermal decomposition temperatures of di-carboxylic acids are higher than those of mono-carboxylic acids. The thermal decomposition temperatures of chain-saturated compounds are higher than those of normal chain-saturated compounds. The thermal decomposition temperatures of chain-unsaturated compounds are higher than those of chain-saturated compounds. The thermal decomposition temperatures of aromatic compounds are higher than those of chain-unsaturated compounds. In addition, thermal decomposition of aromatic di-carboxylic acids start at approximately 200° C. On the other hand, thermal decomposition of normal chain saturated compounds start at approximately 120° C. Thus, the thermal decomposition temperatures of carboxylic acids vary according to differences in molecular structures and molecular weights. However, differences in thermal decomposition temperatures are not considerably large. Accordingly, a carboxylic acid was selected in terms of solubility of carboxylic acid rather than thermal decomposition temperature. Table 1 represents carboxylic acids having high solubility in methanol.

TABLE 1

| Carboxylic acids | | Solubility in methanol |
|---|---|---|
| Normal chain saturated mono-carboxylic acids | buthanoic acid | arbitral |
| | octanoic acid | 1300 g in 100 g of methanol at 10° C. |
| | decanoic acid | 510 g in 100 of methanol at 20° C. |
| | dodecanoic acid | 120 g in 100 g of methanol at 20° C. |
| Chain unsaturated mono-carboxylic acids | acrylic acid | arbitral |

On the other hand, among copper compounds, cupric chloride has high solubility in alcohol. Solubilities of cupric chloride in alcohols are represented in Table 2. Cupric chloride of methanol solution was employed because of high solubility of cupric chloride. Then, carboxylic acid-methanol solution and cupric chloride-methanol solution are mixed together. Thus, copper carboxylate-methanol solution was prepared.

TABLE 2

| Solvent | Solubility in 100 g of saturated solution at 20° C. |
|---|---|
| methanol | 37 g |
| 1-propanol | 19.7 g |
| 1-buthanol | 15.4 g |

Considering compatibility with copper carboxylate solution, phenol resin-methanol solution was employed as a binder. Phenol resin represented by chemical formula 1 already mentioned was employed for phenol resin. Mixture of phenol resin solution and copper carboxylate solution were utilized for liquid infiltrated into inner pores.

EXAMPLE 1

Saturated solution of cupric chloride in methanol and saturated solution of buthanoic acid in methanol were prepared at the temperature of 30° C. After that, both solutions are mixed at the mole ratio of 1:2. Thus, buthanoic acid copper-methanol solution was prepared. Further, 50 wt % of phenol resin powder was solved into methanol for preparing phenol resin-methanol solution. Next, the buthanoic acid copper-methanol solution and the phenol resin-methanol solution were mixed at the volume ratio of 5:1. Then, the mixed solution was infiltrated into inner pores of sintered product of the carbon particles by means of low pressure-infiltration. Low pressure-infiltration is so called vacuum infiltration. In the low pressure-infiltration, samples are immersed in a solution. Then, inside the chamber containing the samples and the solution is evacuated. Then, air contained in the inner pores of the samples is replaced by solution. Thus, the solution is infiltrated in the inner pores of the sample.

Next, the sample was left in atmospheric air of 150° C. for one hour. Then, the sample was left in atmospheric air of 300° C. for two hours. After that, the sample was processed in nitrogen gas-rich atmosphere containing 10 vol. % of hydrogen gas of 350° C. for two hours. During this process, carbon dioxide gas and vapor were vaporized from the phenol resin. Simultaneously, the phenol resin was converted into amorphous carbon. Thus, a motor brush material according to the embodiment of the present invention is obtained. A continuous operation test was performed for a motor made of the brush material.

EXAMPLE 2

Example 2 was processed similarly to example 1 except that octanoic acid was utilized instead of buthanoic acid as a carboxylic acid. Then, a continuous operation test was performed for a motor made of obtained brush material.

EXAMPLE 3

Example 3 was processed similarly to example 1 except that decanoic acid is utilized instead of buthanoic acid as a carboxylic acid. Then, a continuous operation test was performed for a motor made of obtained brush material.

EXAMPLE 4

Example 4 was processed similarly to example 1 except that dodecanoic acid is utilized instead of buthanoic acid as a carboxylic acid. Then, a continuous operation test was performed for a motor made of obtained brush material.

EXAMPLE 5

Example 5 was processed similarly to example 1 except that acrylic acid is utilized instead of buthanoic acid as a carboxylic acid. Then, a continuous operation test was performed for a motor made of obtained brush material.

Comparative Example

A continuous operation test was performed for a motor made of conventional metal-graphite brush material.

Figure 3:
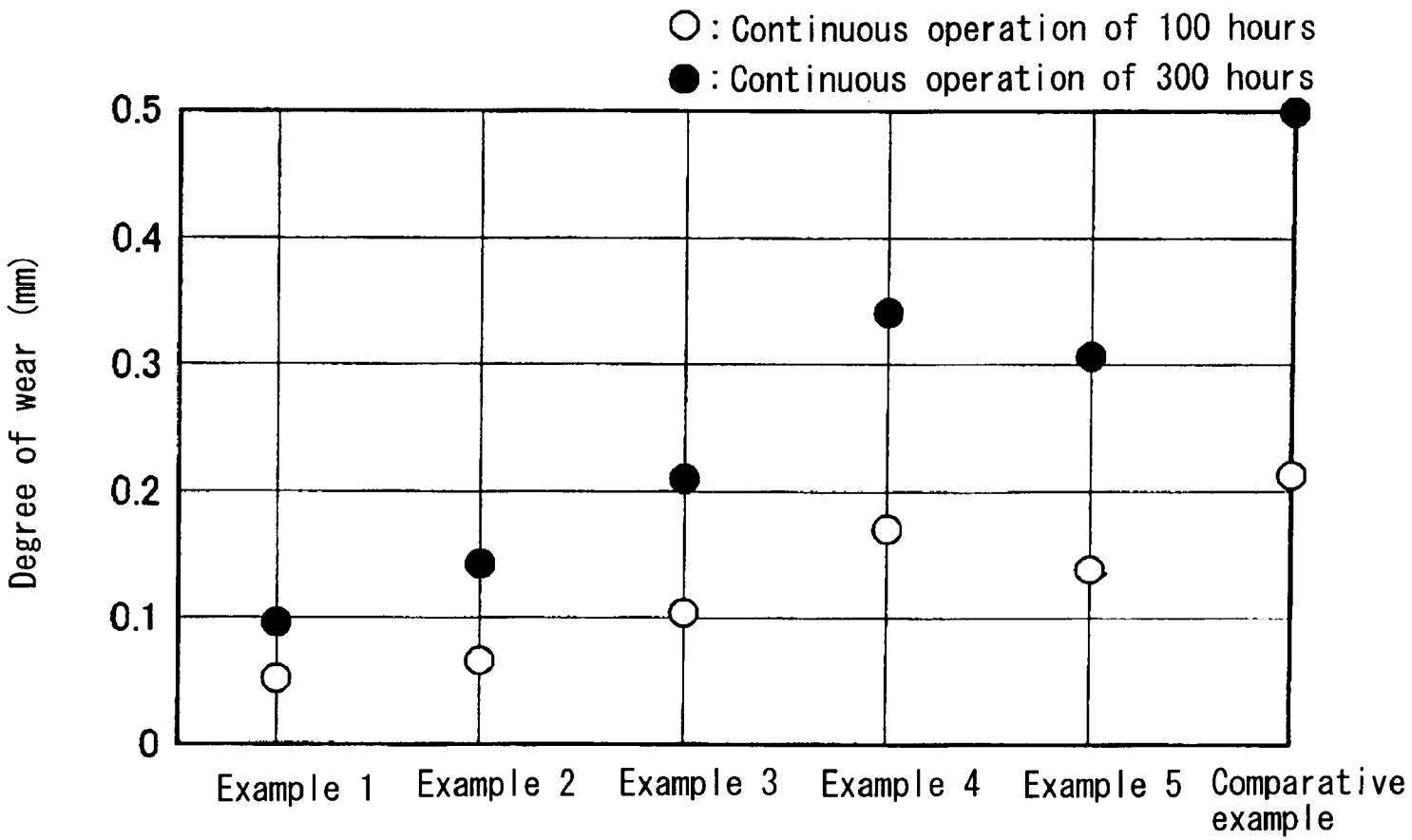
FIG. 3 represents a diagram illustrating the degree of wear of the motor brush material.

Results of continuous operation tests described above are represented in FIG. 3. As can be seen from FIG. 3, the degree of wear of motors made of the brush material according to examples 1 to 5 were smaller than that of the motor made of the conventional metal-graphite brush material. In particular, the motors according to examples 1 to 3 showed less than half degree of wear than that of conventional one in 100 hours-continuous operation tests. 300 hours-continuous operation tests showed greater advantages of examples 1 to 3 than those shown in 100 hours-continuous operation tests. The reason can be assumed that high density of copper microparticles were formed in pores because of high solubility of copper carboxylate in methanol. In addition, in example 5, even though acrylic acid copper has high solubility in methanol, obtained effects were smaller than those obtained in examples 2 and 3. The reason is assumed that growing speed of copper oxide generated by thermal decomposition of the acrylic acid, which is only chain-unsaturated mono-carboxylic acid in examples, is different from those of the normal chain-saturated mono-carboxylic acids.

According to an aspect of the present invention, a motor brush material contains copper particles dispersed and configuring particle group structure supported in inner pores of a sintered body containing carbon as a major component.

According to the aspect of the present invention, the number of cores of spark discharge can be increased substantially. Thus, energy of the spark discharge can be dispersed into the cores of the spark discharge. Accordingly, the energy of one spark discharge can be reduced. Further, volume of one core of the spark discharge can be substantially reduced. Thus, the amount of charge stored in one core of the spark discharge can be reduced. Accordingly, the energy emitted from the spark discharge can be reduced.

Accordingly, effects caused by the spark discharge of the motor brush material can be reduced. And simultaneously, a degree of wear of a brush made of the motor brush material can be reduced. Further, because the amount of charge of discharge is reduced, a level of noise signals caused by the spark discharge can be lowered.

According to a further aspect of the present invention, the copper particles are supported in the inner pores by amorphous carbon.

According to the aspect of the present invention, the amorphous carbon has an electric resistance close to that of carbon particles, and the amorphous carbon is easily destructed by mechanical stress as same as carbon particles. Accordingly, properties of the amorphous carbon do not give undesirable influence on the sliding ability of the brush.

According to a further aspect of the present invention, a method for manufacturing a motor brush material includes the steps of infiltrating solution containing a copper complex into inner pores of a sintered body containing carbon particles by means of low-pressure infiltration, and generating copper particles in the inner pores by means of thermal decomposition of the copper complex.

According to the aspect of the present invention, the solution containing the copper complex can be infiltrated into the inner pores of the sintered body by means of low-pressure infiltration. The solution can be maintained in the inner pores. Then, the copper microparticles generated by thermally decomposing the copper complex in the inner pores can be supported in the inner pores.

According to a further aspect of the present invention, in the method for manufacturing a motor brush material, the step of generating copper particles by means of thermal decomposition of the copper complex includes the steps of performing a heat process on the copper complex in oxidative atmosphere for thermally decomposing the copper complex and precipitating copper atoms and generating copper oxide, and performing a reduction process on the copper oxide in reductive atmosphere for reducing the copper oxide into the copper particles.

According to the aspect of the present invention, the heat process of the copper complex in the oxidative atmosphere can separate copper atoms from the complex, oxidize the copper atoms into the copper oxide, and grows the copper oxide particles from the copper oxide. Then, the copper oxide particles can be reduced into the copper particles by means of the reduction process. Accordingly, the step of forming the copper particles from the solution of the copper complex and the step of supporting the copper particles in the inner pores can be performed simultaneously.

According to a further aspect of the present invention, in the method for manufacturing a motor brush material, the solution containing the copper complex further contains a binder.

According to the aspect of the present invention, the solution containing the copper complex can be infiltrated in the inner pores of the motor brush material with the binder. Then, successive process can be performed on the motor brush material. Accordingly, the generated copper particles can be supported in the inner pores.

According to a further aspect of the present invention, the binder has a thermal decomposition temperature higher than that of the copper complex, and the binder is reduced into amorphous carbon in the process of reducing the copper oxide into the copper particles.

According to the aspect of the present invention, the binder can be reduced into the amorphous carbon in the step of reducing the copper oxide into the copper particles. On the other hand, the binder is not decomposed in the step of thermally decomposing the copper complex and in the step of oxidative reaction of the copper atoms. Accordingly, the binder can be infiltrated in the inner pores with the solution of the copper complex, and the copper particles generated in the inner pores can be supported by the amorphous carbon.

According to a further aspect of the present invention, in the method for manufacturing a motor brush material, the copper complex is a copper carboxylate complex.

According to the aspect of the present invention, because the copper carboxylate complex can form metal particles under the condition of relatively low temperature, particles can grow at lower growing speed. Accordingly, the particles can be formed finer.

According to a further aspect of the present invention, the binder is a phenol resin.

According to the aspect of the present invention, higher conversion rate of the binder into amorphous carbon can be ensured. Accordingly, desired thermal decomposition property can be obtained.

A brush made of a motor brush material according to the embodiment of the present invention can be employed for a brush for a motor utilized for driving a water pump for a cooling engine of a vehicle, a motor utilized for rotating a cooling fan, a motor utilized for driving an oil pump of an engine or the like.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A method for manufacturing a motor brush material, comprising the steps of: infiltrating solution containing a copper complex into inner pores of a sintered body containing graphite particles by means of low-pressure infiltration; and generating copper particles in the inner pores by means of thermal decomposition of the copper complex.

2. The method for manufacturing a motor brush material according to claim 1, wherein the step of generating copper particles by means of thermal decomposition of the copper complex includes the steps of performing a heat process on the copper complex in oxidative atmosphere for thermally decomposing the copper complex and separating copper atoms from the copper complex and generating copper oxide particles, and performing a reduction process on the copper oxide in reductive atmosphere for reducing the copper oxide particles into the copper particles.

3. The method for manufacturing a motor brush material according to claim 2, wherein the solution containing the copper complex further contains a binder.

4. The method for manufacturing a motor brush material according to claim 3, wherein the binder has a thermal decomposition temperature higher than that of the copper complex, and the binder is reduced into amorphous carbon in the process of reducing the copper oxide into the copper particles.

5. The method for manufacturing a motor brush material according to claim 1, wherein the binder is a phenol resin.

6. The method for manufacturing a motor brush material according to claim 1, wherein the solution containing the copper complex further contains a binder.

7. The method for manufacturing a motor brush material according to claim 6, wherein the binder has a thermal decomposition temperature higher than that of the copper complex, and the binder is reduced into amorphous carbon in the process of reducing the copper oxide into the copper particles.

8. The method for manufacturing a motor brush material according to claim 6, wherein the binder is a phenol resin.

9. The method for manufacturing a motor brush material according to claim 1, wherein the copper complex is a copper carboxylate complex.

10. The method for manufacturing a motor brush material according to claim 1, wherein the solution containing the copper complex infiltrated into the inner pores of the sintered body is manufactured by mixing a copper carboxylate-alcohol solution and a phenol resin-alcohol solution.

11. The method for manufacturing a motor brush material according to claim 1, wherein the solution containing the copper complex infiltrated into the inner pores of the sintered body is manufactured by the steps of preparing saturated cupric chloride-methanol solution and saturated buthanoic acid-methanol solution, mixing the saturated cupric chloride-methanol solution and the saturated buthanoic acid-methanol solution at the mole ratio of 1:2 for preparing buthanoic acid-copper-methanol solution, solving powder of a phenol resin into methanol for preparing a phenol resin-methanol solution, and mixing the buthanoic acid-copper-methanol solution and the phenol resin-methanol solution at the volume ratio of 5:1.

* * * * *